US009962764B2

(12) United States Patent
Maranitsch et al.

(10) Patent No.: US 9,962,764 B2
(45) Date of Patent: May 8, 2018

(54) FIREPROOF CERAMIC BOTTOM

(71) Applicant: REFRACTORY INTELLECTUAL PROPERTY GMBH & CO. KG, Vienna (AT)

(72) Inventors: Alexander Maranitsch, Vienna (AT); Matthias Hoeck, Vienna (AT); Marcus Kirschen, Seckau (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 166 days.

(21) Appl. No.: 14/648,140

(22) PCT Filed: Dec. 3, 2013

(86) PCT No.: PCT/EP2013/075299
§ 371 (c)(1),
(2) Date: May 28, 2015

(87) PCT Pub. No.: WO2014/106553
PCT Pub. Date: Jul. 10, 2014

(65) Prior Publication Data

US 2015/0298210 A1 Oct. 22, 2015

(30) Foreign Application Priority Data

Jan. 7, 2013 (EP) ..... 13150422

(51) Int. Cl.
*B22D 41/02* (2006.01)
*B22D 41/08* (2006.01)
*F27D 1/00* (2006.01)

(52) U.S. Cl.
CPC ..... *B22D 41/02* (2013.01); *B22D 41/08* (2013.01); *F27D 1/0003* (2013.01); *F27D 1/0043* (2013.01)

(58) Field of Classification Search
CPC ..... B22D 41/02; B22D 41/08; F27D 1/0003; F27D 1/0043
(Continued)

(56) References Cited

U.S. PATENT DOCUMENTS 3,695,604 A 10/1972 Stein
4,432,536 A * 2/1984 Coordes ..... B22D 41/02 266/217
(Continued)

FOREIGN PATENT DOCUMENTS

JP S50122217 A 9/1975
JP S5148835 A 4/1976
(Continued)

OTHER PUBLICATIONS

Masse F, "Resultats Obtenus en Fonds de Poche a Acier Par la Mise en Place D'une Couche de Securite Incurvee en Blocs Prefabriques de Betons Refractaires", Bd. 88, Nr. 7/08, Jan. 7, 1991, pp. 781-788.
(Continued)

*Primary Examiner* — Scott Kastler
*Assistant Examiner* — Michael Aboagye
(74) *Attorney, Agent, or Firm* — Medley, Behrens & Lewis, LLC

(57) ABSTRACT

An exemplary embodiment relates to a fireproof ceramic bottom in the connection region to at least one wall of a vessel for handling high-temperature melts.

8 Claims, 5 Drawing Sheets

Figure 1A:
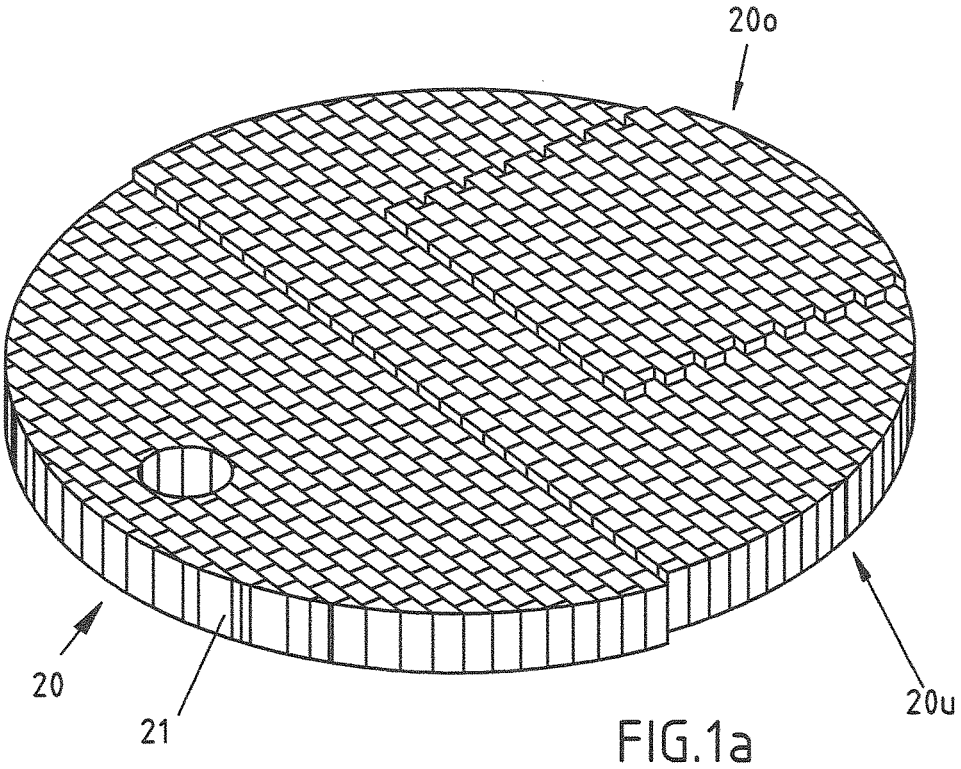

(58) Field of Classification Search
USPC ..... 266/280, 286, 236, 275, 45, 281, 283, 266/284; 264/30, 35
See application file for complete search history.

(56) References Cited

U.S. PATENT DOCUMENTS

| | | | | |
|---|---|---|---|---|
| 5,462,572 | A * | 10/1995 | Tallback | B01F 13/0001 266/234 |
| 5,529,729 | A * | 6/1996 | Eitel | B22D 1/005 264/30 |
| 5,879,616 | A * | 3/1999 | Erny | B22D 41/02 266/236 |
| 6,673,306 | B2 | 1/2004 | Abrino et al. | |
| 8,110,142 | B2 * | 2/2012 | Barrett | B22D 41/02 266/283 |
| 2009/0206528 | A1 | 8/2009 | Barrett et al. | |
| 2012/0126467 | A1 | 5/2012 | Barrett et al. | |

FOREIGN PATENT DOCUMENTS

| | | | |
|---|---|---|---|
| JP | S62130212 | A | 6/1987 |
| JP | H03169473 | A | 7/1991 |
| JP | H1047861 | A | 2/1998 |

OTHER PUBLICATIONS

International Search Report for App. No. PCT/EP2013/075299 dated May 8, 2014.

* cited by examiner

FIREPROOF CERAMIC BOTTOM

The invention relates to a fireproof ceramic base (bottom) in the connection area to at least one wall of a vessel for the treatment of a high temperature melt.

The vessel can for example be a metallurgic ladle. The state of the art and the invention are described further in the following using this application.

Such a ladle is for example shown in the U.S. Pat. No. 5,879,616 A. Strongly simplified, it consists of a base and a wall running upwards from the base with a mostly round inner cross section so that overall a kind of pot shape is created. At least one hole (discharge area) is arranged in the base.

A metal melt treated in the ladle gets into a downstream installation, for example a tundish, via the discharge (tap). For the regulation/control of the amount of metal melt, there is for example a stopper or a sliding plate valve, also called control means.

If slag also gets into the tundish, the quality of the steel is decreased as well as the durability of the tundish. Therefore it is attempted to shut the discharge opening immediately as soon as the slag has reached the discharge opening. The ladle is then tipped with the leftover amount of melt and slag. Thereby significant losses of material and high costs for the recycling arise.

Because the slag is lighter than the metal melt (steel melt) it mainly floats on the metal bath. Therefore the surface of the ladle base has been designed in a sloped manner, in order to transport as much liquid metal through the discharge tap (opening), which is as the lowest point of the base, as possible, before the slag flows through it.

This requires a correspondingly complicated shape of the base. The fireproof lining of the base gets complex and expensive.

The invention underlies the object to present a construction, at which as much melt as possible can be removed from the melting vessel in a good quality.

In order to solve this object, the invention suggests the following measures:

As a matter of principle, it is advantageous to transport the melt along a sloped surface to the discharge opening (nozzle). Therefore, the base according to the invention should, at least in segments, be sloped compared to the horizontal. The sloped surface should decline especially towards the discharge area.

In order to ensure reproducible conditions during pouring, the shape of the base, across which the melt flows, should possibly always be consistent. This means that the shape of the base, and especially the surface of the base, ideally remains unchanged (within boundaries of technical tolerances) even after a repair or an exchange of the worn out fireproof material.

A newly produced monolithic wear lining, as it is described in the U.S. Pat. No. 5,879,616, necessarily features a different geometry after a repair.

The invention follows another path: The base is formed out of a fireproof (refractory) permanent lining, onto which a wear lining is arranged.

The permanent lining, or more specific: the surface of the permanent lining, provides the desired geometry for the wear lining. The permanent lining accordingly features at least one sloped area and a three dimensional shape.

The permanent lining does not have to be renewed over a longer period of time, because it is not subject to any wear.

Only the wear lining which is arranged on top of the permanent lining is used up and has to be repaired or replaced from time to time.

If the wear lining is laid onto the permanent lining in the form of fireproof bricks, it is immediately revealed that the upper side of the wear lining features the same, or generally the same shape (geometry) as the upper side of the permanent lining. This is especially valid whenever the bricks of the wear lining are generally identical and generally laid in the same direction.

This is also valid, if single bricks, brick areas or the whole wear lining is replaced or renewed, because the permanent lining remains untouched in the process and still defines the desired surface geometry.

The aforementioned characteristics are valid within boundaries of the technical circumstances. A (sloped) base out of a fireproof ceramic material can never be exactly planar (sloped planar) in a mathematical/physical way and in case of a ladle with a round inner cross section there are inevitably transitions between the bricks to the wall or between the bricks and the discharge area, which have to be filled in a separate step. To do this details are given in the following. However these are only supporting measures, as the main part of the wear layer can be made of standard bricks.

In its most general embodiment the invention relates to a fireproof ceramic base in the connection area to at least one wall of a vessel for the treatment of a high temperature melt, with the following characteristics:

- the base features at least two layers, namely:
  - a lower layer made of a fireproof ceramic permanent lining and
  - an upper layer made of a fireproof ceramic wear lining, wherein
  - the permanent lining features a surface bordering to the wear lining, which is, at least in segments, sloped compared to the horizontal by more than 1°,
  - this surface features a three dimensional design, and
  - the wear lining consists to at least 60 M.-% out of ceramic solid bricks,
  - permanent lining and wear lining each feature at least one inconsistency for the formation of at least one common discharge opening for the high temperature melt.

Information like "top, bottom" etc. always refer to the normal in-use position of the vessel.

The term "solid brick" includes all types of classical fireproof ceramic bricks, regardless of their geometry or composition. Solid bricks are particularly compact fireproof bricks in shape of a cuboid, a column or a three-dimensional polygon with a mainly homogenous inner structure. The open and/or closed porosity should be as low as possible, for example <20 Vol.-%, better <15 Vol.-%, <10 Vol.-% or <5 Vol.-% (where Vol.-% refers to percentage of volume).

Especially those bricks are excluded, that feature an opening or individual larger cavities and/or bricks for special metallurgical applications such as gas purging plugs and other functional elements. However a nozzle or a gas purging plug can be built into the permanent lining as well as into the wear lining as a discrete independent element. "Discrete independent element" means a use independent from the wear lining.

According to the invention, at least 60M.-% of the wear lining should consist of such solid bricks. This value can also be >65M.-%, >70M.-%, >75M.-%, >80M.-%, >85M.-%, >90M.-%, >93M.-%, or >95M.-% (where M.-% refers to percentage of mass). The corresponding percentage of solid bricks depends on the shape, the dimensions and the size of the corresponding ladle. It should be as high as possible, in order to recreate the surface structure of the permanent lining as well as possible.

The remaining part can for example be formed out of a fireproof mass, which is applied in the transition area between adjacent bricks, between bricks and the wall, or at other elements, in the discharge area etc., in order to fill pendentives (gaps). Further information about this is given in the following.

According to one embodiment, the permanent lining consists of a monolithic fireproof mass. The whole permanent lining can be produced in-situ or at an arbitrary place, even outside of the plant, inside which the melt vessel is used. It is advantageous to design the permanent lining as a prefabricated element. The prefabricated element can consist of one or multiple parts (for example 2 to 10 parts) and can consist for example out of elements which complement one another into a full permanent lining. The permanent lining of the base is then built into the ladle and afterwards the wear lining is put on tope of the permanent lining.

The three dimensional shape of the permanent lining is important, because it decides what the surface structure of the wear lining is like. The surface structure of the wear lining is important because this surface is in contact with the melt and in order to be able to lead as much melt as possible at a high quality through the discharge.

The permanent lining can feature different external and internal installations, for example:

- an installation for the creation of an impact area (of an impact pad) for the melt
- a step for the drainage of the melt
- an indentation for the internal installation of a gas purging plug, a well block, or similar
- a bowl-shaped indentation
- an upwards pointing wall for the formation of a weir The wear lining adopts these shapes directly, as previously described.

The surface of the permanent lining and therefore also the corresponding surface of the wear lining can be completely or partially sloped. The maximum slope is usually at 45° to the horizontal, with possible upper limits at 30°, 25°, 15° or 10° and possible lower limits of 1.5°, 2°, 3°, 4°, 5° or 8°.

According to one embodiment, the surface of the permanent lining, which is adjacent to the one of the wear lining, is at least at segments sloped by 2° to 25° compared to the horizontal. Segments in proximity to the discharge opening (the tap) can feature a steeper slope than segments in the wall area of the metallurgic vessel.

The surface shape of the wear lining is even more similar to the surface shape of the permanent lining, if the following parameters are taken into account at least individually or better in combination:

- At least 75% of the solid bricks of the wear lining are laid in a single layer. A higher consistency is reached, if that value is >80%, >85%, >90% or even >95%.
- At least 60%, or better, at least 65%, 70%, 75% or 80% of the solid bricks of the wear lining are identical. The parallelism between the surfaces of the permanent lining and the wear lining is optimized, if more than 85%, for example >90% or 95% of the bricks of the wear lining are identical.
- The bricks of the wear lining are mainly (>80%, >85%, >90%, >95%) laid in the same orientation or in a consistent pattern, for example a "fish bone pattern".

The invention allows inserting the solid bricks of the wear part at least partially as premade segments, each consisting of multiple solid bricks. Thereby reparations can be simplified.

As mentioned, the geometry of the bricks is not crucial. However, bases, whose wear lining consists of at least 70M.-% or at least 75M.-% solid bricks, which feature a triangular, rectangular or polygonal shape in the top view (plan view), can be made particularly easily.

According to a further embodiment, the wear lining consists of at least 80M.-% solid bricks, which have their largest extension in a vertical direction.

Generally the bricks of the wear layer can be made out of any fireproof material, for example out of at least one material of the following group: Magnesia (MgO), Alumina ($Al_2O_3$), Magnesia-Carbon (MgO—C), Doloma (MgO—CaO), Magnesia-Chromite (MgO—$Cr_2O_3$), $TiO_2$.

At the ladle with a round/circular inner cross section and cuboid bricks for the permanent—or wear lining, pendentives/gaps arise inevitably between the base and the wall. Analogous pendentives can for example arise

- between the solid bricks
- between the solid bricks and the permanent lining
- between the solid bricks and a separate element in the base These pendentives can be filled with a fireproof ceramic mass. This application can take place manually or automatically, for example by stamping, gunning or jointing.

In order to avoid joints (grooves) between adjacent solid bricks of the wear lining, one embodiment of the invention suggests the following: Solid bricks, which lie on a surface of the permanent lining, which is sloped by at least 1.5° to the horizontal, are for example arranged offset in a step like manner, as shown in the figure description (as long as no planar support is possible).

The invention presents the following advantages compared to the state of the art:

- Any fireproof types can be used for the wear lining.
- Masses that feature a high solidity and a high hydration resistance make sense for a monolithic permanent lining, for example alumina masses.
- The mounting time of the base is short, because the permanent lining, which is not renewed, already defines the shape of the surface of the finished base.
- The mounting of the permanent lining as a premade/prefabricated element optimizes the mounting of the whole base arrangement.
- Errors during the mounting are generally impossible, as the permanent lining remains unchanged.
- The laying of the bricks of the wear layer is simple, errors during the selection of the formats or positioning of the bricks are minimized.
- Complex base shapes can also be produced.
- Internal and external installations can be easily integrated.
- The permanent lining is not in contact with the melt; therefore its service time is additionally increased, even if cheap fireproof materials are used. The profile of the permanent lining is permanently conserved.
- During tapping, the vessel only has to be tipped/tilted slightly.
- The consumption of fireproof material is reduced.

Further characteristics of the invention are shown in the characteristics of the sub claims as well as the further application documents. Individual characteristics can also be applied in different combinations, as long as this is not explicitly excluded or technically absurd.

Figure 1B:
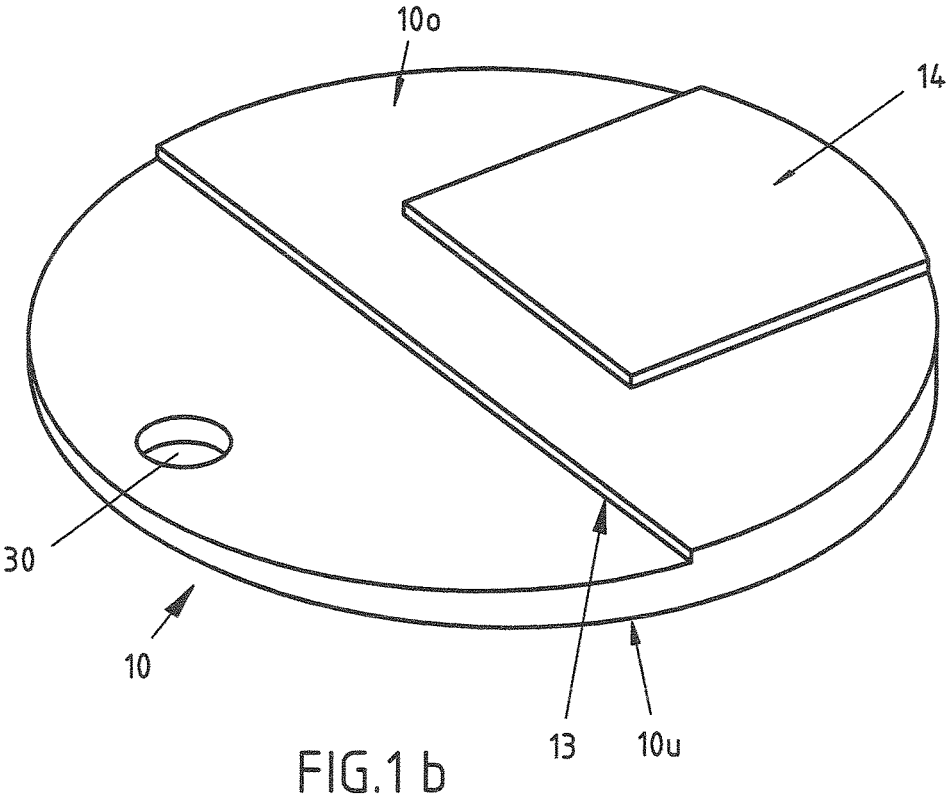
Figure 1C:
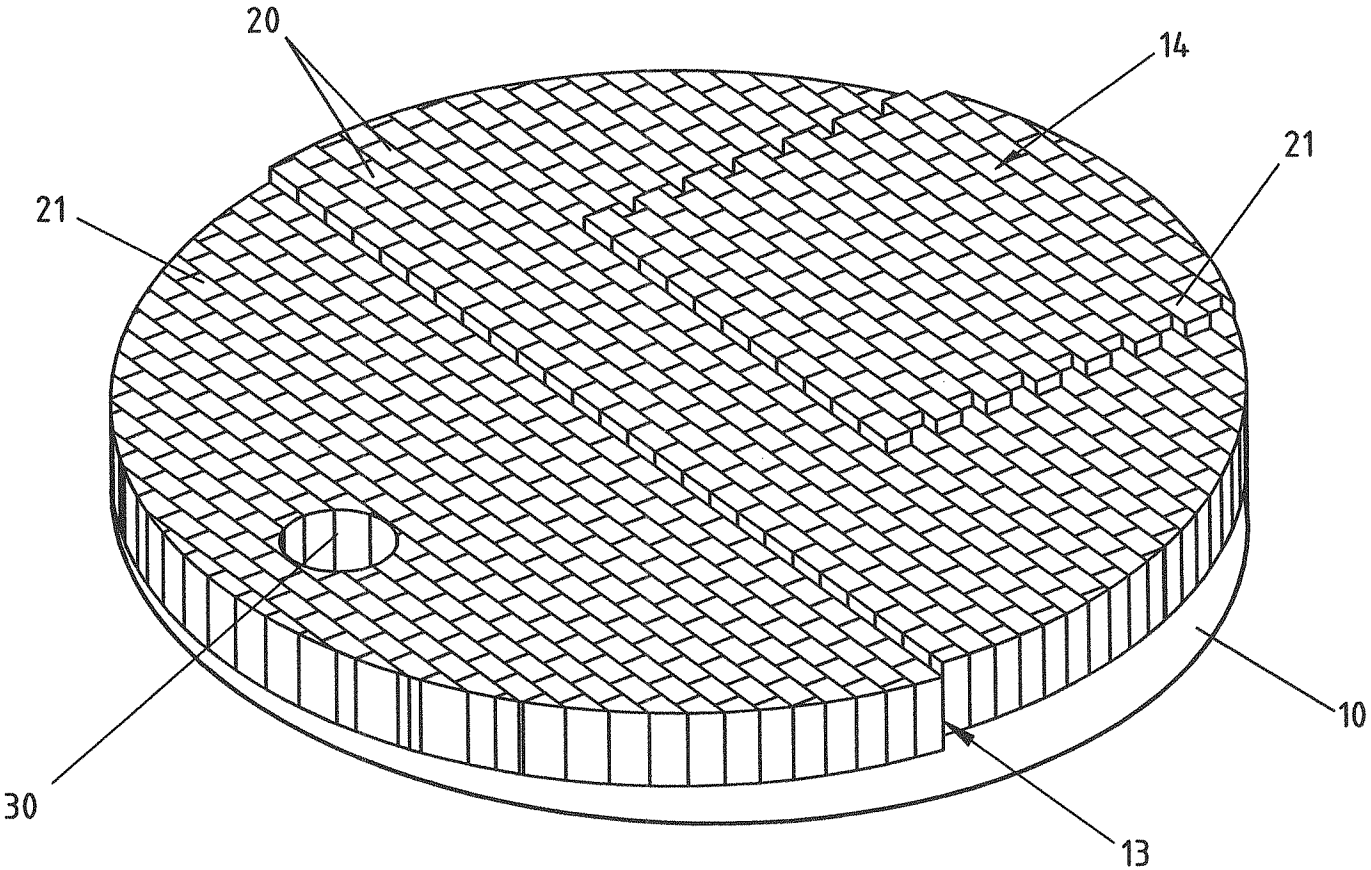

The invention is described further in the following with help of different embodiments. It is shown, each in a strongly schematic display, in:

FIG. 1: a perspective view of a base of a ladle according to the invention in an explosive view (FIG. 1*a, b*) and after assembly (FIG. 1*c*)

Figure 2:
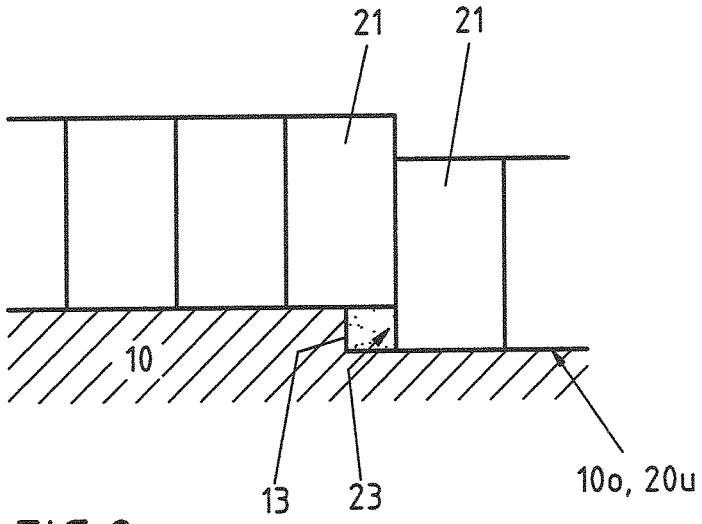

FIG. 2: a partial cross section through a first segment of the base

Figure 3:
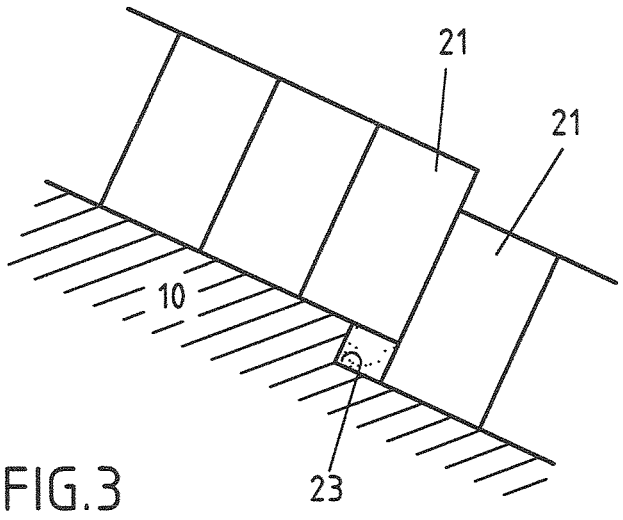

FIG. 3: a partial cross section through a second segment of the base

Figure 4:
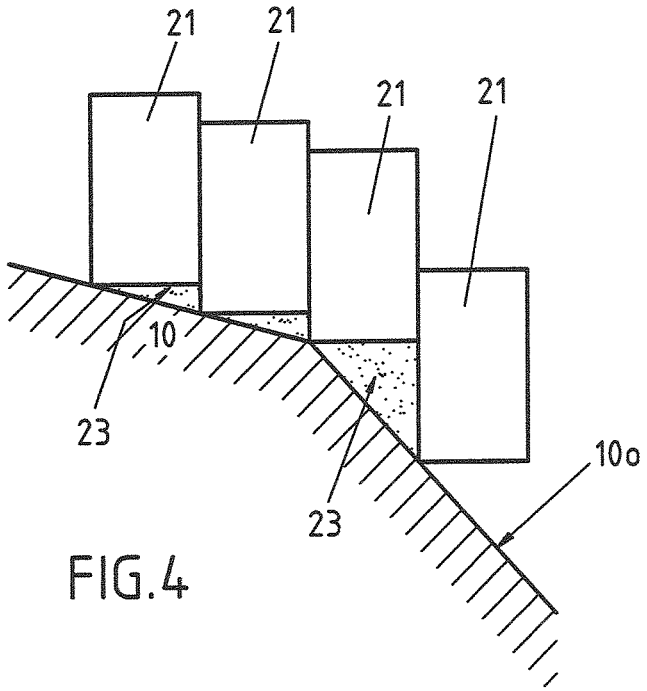

FIG. 4: a partial cross section through a third segment of the base

Figure 5:
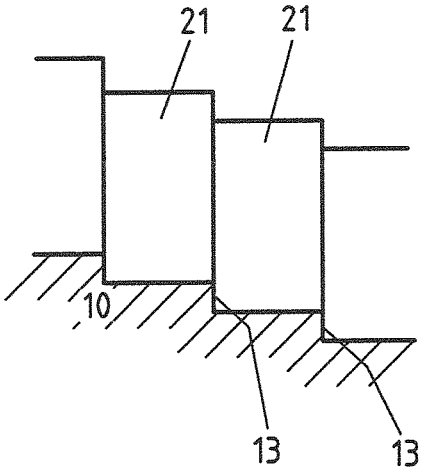

FIG. 5: a partial cross section through a fourth segment of the base

Figure 6:
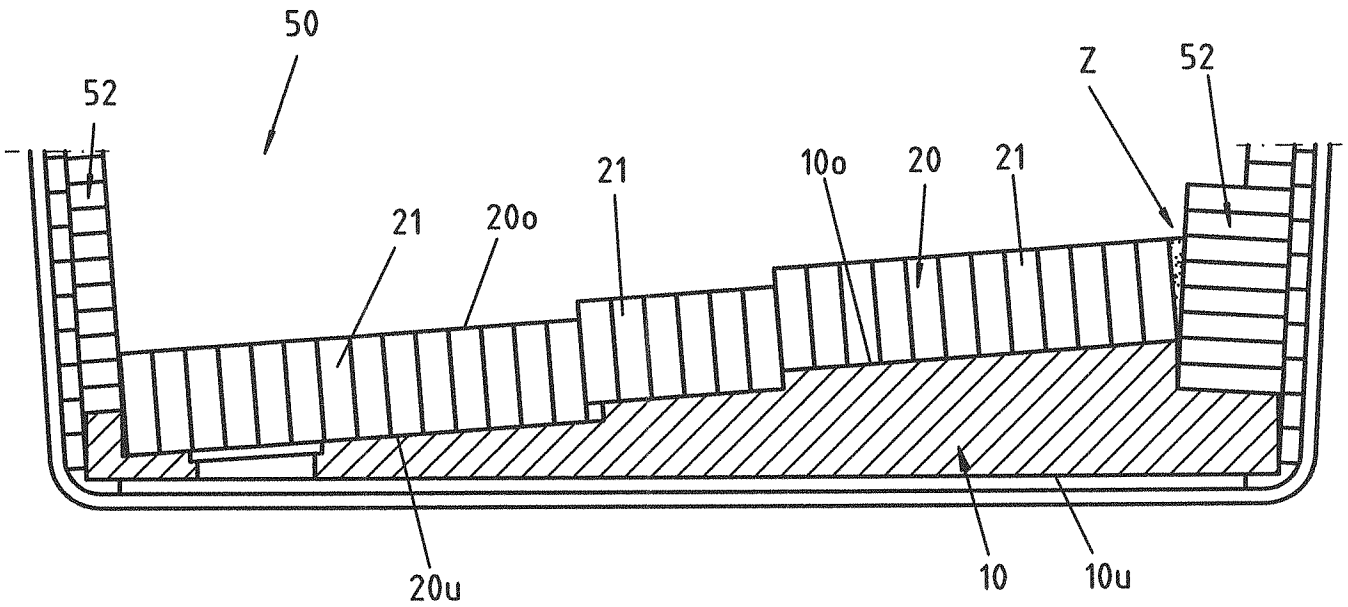

FIG. 6: a cross section through the ladle with the base analogue to FIG. 1

In the figures, identical or similarly appearing elements are displayed with the same reference numbers. An arrangement is described, where the ladle is aligned exactly vertically.

FIG. 1 shows a base with two layers, namely a lower layer 10 and an upper layer 20 which is arranged on top. Both are approximately circular in the top (plan) view.

The lower layer 10 is designed as a permanent lining and is made of a fireproof ceramic mass on an alumina basis. The permanent lining 10 is designed completely as a prefabricated element and features a horizontal lower surface 10*u* and a three dimensionally designed upper surface 100. The surface 10*o* features the following areas:

a first step 13 approximately in the centre a raised impact pad 14 in the left upper third all areas of the surface 10*o* are sloped by approximately 3° to the horizontal—with a slope in direction towards a discharge area 30.

The upper layer 20, so the wear layer, consists mainly (to >80M.-%) of cuboid fireproof bricks 21 of same size in a consistent layout, except in the area of the discharge 30.

Hence the geometry of the lower side 20*u* and the upper side 200 of the wear layer 20 generally follows the geometric conditions of the upper side 100 of the permanent lining 10.

Differences are only created by the fact, that the bricks 21 (solid bricks) are slightly offset in the area of the step 13 (slope: approximately 90°), as shown in FIG. 2. The thereby created space 23 between the upper side 100 of the permanent lining and the lower side 20*u* of the brick 21.1 is filled up with a fireproof mass on an alumina basis.

This is analogously valid for steps in areas with a slope of for example 25° (FIG. 3) or the positioning of the solid bricks 21 at consecutive sloped surfaces with different slopes (FIG. 4).

FIG. 5 shows an embodiment, wherein the planar sloped surfaces of FIGS. 3,4 are replaced by a step-like contour, which however—technically—altogether create a slope similar to the one in FIG. 3. Insofar, the term "sloped surface" technically also includes embodiments with corresponding consecutive small steps 13 (FIG. 5).

As shown in FIGS. 1 and 6, there are also pendentives Z between the bricks 21 and a neighbouring curved vessel wall 52 of a ladle 50. These areas are also filled with a monolithic fireproof mass.

At a base according to the invention, only the wear lining 20 is replaced. In order to do so, the bricks 21 and possible further elements of the wear lining 20 are dismantled. The permanent lining 10 remains unchanged. The new wear lining 20 is therefore built back onto the existing geometry of the permanent lining 10 so that the upper side 200 of the wear lining 20 corresponds to the surface geometry of the permanent lining 10 again.

Thereby, a simple, fast and cheap repair option is provided, wherein the three dimensional design is determined automatically by the unchanged permanent (durable) lining 10.

The invention claimed is:

1. Fireproof ceramic base in a connection area to at least one wall (52) of a vessel (50) for treatment of a high temperature melt, with the following characteristics:

a) the fireproof ceramic base features at least two layers (10, 20), namely b) a lower layer made of a fireproof ceramic permanent lining (10) comprising at least one monolithic fireproof mass, and c) an upper layer made of a fireproof ceramic wear lining (20), wherein d) the permanent lining (10) features a surface (10*o*) which is adjacent to the wear lining (20), which is sloped by at least 2° to 25° compared to the horizontal, e) this surface (10*o*) features a three dimensional design including at least one step (13), and f) the wear lining (20) consists of at least 60 M % of fireproof ceramic solid bricks (21), wherein at least 60% of the solid bricks of the wear lining (20) are identical, wherein at least 70 M % of said solid bricks feature a rectangular or polygonal profile in a top view, and wherein at least 75% of the solid bricks (21) of the wear lining (20) being laid in a single layer, g) the permanent lining (10) and the wear lining (20) feature at least one inconsistency for integration of at least one common discharge opening (30) for the high temperature melt.

2. Base according to claim 1, whose permanent lining (10) is a premade element which has been made out of at least one monolithic fireproof mass.

3. Base according to claim 1 with at least one separate element (14, 30) which is built into the permanent lining (10) and the wear lining (20).

4. Base according to claim 1, wherein the solid bricks (21) of the wear lining (20) are at least partially laid as pre-assembled segments consisting of multiple solid bricks.

5. Base according to claim 1, whose wear lining (20) consists of at least 80 M % solid bricks (21), which have their largest extension in a vertical direction.

6. Base according to claim 1, wherein the solid bricks (21) of the wear lining (20) consist of at least one material, wherein the material is Magnesia, Alumina, Magnesia-Carbon, Doloma, or Magnesia-Chromite.

7. Base according to claim 1, wherein pendentives (23)

between the solid bricks (21)

between the solid bricks (21) and the at least one wall (52) of the vessel (50)

between the solid bricks (21) and the permanent lining (10)

between solid bricks (21) and a separate element (14, 30) in the base are at least partially filled with a fireproof ceramic mass.

8. Base according to claim 3, wherein pendentives (23)

between the solid bricks (21)

between the solid bricks (21) and the at least one wall (52) of the vessel (50)

between the solid bricks (21) and the permanent lining (10)

between solid bricks (21) and a separate element (14, 30) in the base are at least partially filled with a fireproof ceramic mass.

* * * * *